United States Patent [19]

Tunstall

[11] Patent Number: 4,695,054

[45] Date of Patent: Sep. 22, 1987

[54] GOLF CLUB

[76] Inventor: Timothy F. Tunstall, P.O. Box 434, Springfield, Mass. 01101

[21] Appl. No.: 837,956

[22] Filed: Mar. 10, 1986

[30] Foreign Application Priority Data

Mar. 13, 1985 [IE] Ireland ..... 643/85

[51] Int. Cl.[4] ..... A63B 53/06

[52] U.S. Cl. ..... 273/171; 273/167 H; 273/173

[58] Field of Search ..... 273/171, 169, 170, 172, 273/173, 174, 175, 167 F, 167 H, 168

[56] References Cited

U.S. PATENT DOCUMENTS 3,143,349 8/1964 MacIntyre ..... 273/171

4,085,934 4/1978 Churchward ..... 273/171

*Primary Examiner*—George J. Marlo

*Attorney, Agent, or Firm*—Ross, Ross & Flavin

[57] ABSTRACT

A golf club previously swingweighted to a standard reference swingweight, has a base nested in a provided recess in the bottom portion of the club head. The base is provided with a pair of recesses, one on the toe side of the head and one on the heel side of the head for slidably receiving in each a barrel together with a selected number of weight discs and a compressible member for maintaining the discs in tight relationship within their respective barrel, whereby a club owner may swingweight his club to any desired swingweight.

1 Claim, 3 Drawing Figures

GOLF CLUB

My invention relates to a club for striking a ball, and in particular, to a golf club.

In the case of a golf club, it is essential that the club be accurately balanced. This is particularly true of the putter. However, by virtue of its particular construction, it has been difficult to ensure that the head of the putter as known heretofore is always accurately balanced.

This invention is directed toward providing a golf club, or indeed any other type of gaming club, which overcomes this vexing problem.

The preferred embodiment of the invention, the club is shown as a golf club, and more particularly a putter.

The club head envisions a base and a cover extending above the base, and a shaft which is sleeved upon a threaded stub fixed to and extendable upwardly from the cover.

The base is nestably received in a provided recess in the cover and is secured thereto by means of a screw extendable through the base and threadedly engaged with the cover.

Stated otherwise, the inention provides a club for striking a ball, the club comprising a shaft and a head, wherein the head comprises a base and a cover extending over the base, the cover being associated with the shaft, and the base being releasably engaged with the cover.

The base is secured to the cover by means of a screw, and preferably, the screw is releasably retained in the base.

A ball striking plate is provided on the head, and is secured to the cover by means of a screw.

The club head has means to receive a weight, and preferable, means to receive a plurality of weights.

Preferably, the means to receive the weight is provided in the base, and advantageously, is provided by a recess of circular cross-sectional area. Preferably, the recess is provided by a bore extending partly into the base. A pair of such recesses, one on either side of the base-to-cover screw allows an arrangement for a desired balancing of the club to meet the individual requirements of any particular user.

One recess is provided on the heel side of the club and one recess is provided on the toe side of the club.

Advantageously, the weights are of disc-like configuration.

A cylindrical shell or barrel with a partly closed end cap is provided to hold the weights, and advantageously, a compressible foam or sponge-like member is provided at the end of the bore to bias the weights into the shell. Care is taken to use the compressible member to ensure against movement of the weights during play.

The discs or weights are double-disc ground, solid brass members and the barrels for accomodating same fall within a 0.005" in dimensional accuracy and 0.01% in weight tolerance.

The compressible member biases the weights against the base.

The functional heart of the club lies in the weighting system which is offered.

The key to my concept is initiated with the design. Each disc which is added to the heel weight chamber or to the toe weight chamber represents what I characterize as a "swing weight" in the case of a standard club length.

Each barrel equals three discs in weight.

There are several techniques for adjusting the weights. Individual discs can be placed in either or both weight wells in conjunction with the foam inserts. The swingweight barrels can be positioned in the concave or convex attitude (disc chamber positioned up or down) to effect high or low mass concentration in the club head.

To add further weight, additional discs can be placed within the barrels. The player is encouraged to experiment with his/her weight system as there are over twelve ways to affect the feel of the putter.

An exact "sweet spot" is identified as the finished brass face screw. As you address the ball, you notice the in-sight-balance-line across the top of the head. This indicates the position on the club face that will produce a very sweet "click."

By examining the sole portion of the putter, one will notice the shape as a complex curve. Aside from the natural radius common to most putters, a camber perpendicular to the radius—extending from the face plate out towards the back of the club is to be seen.

To address a putt, one places the club firmly on the green. By soling the club in this way, the camber produces an effective face loft of 2.67 degrees from the horizontal axis. This eccentricity has been carefully calculated whereby following the club head camber promotes a truly pendulum stroke.

Figure 1:
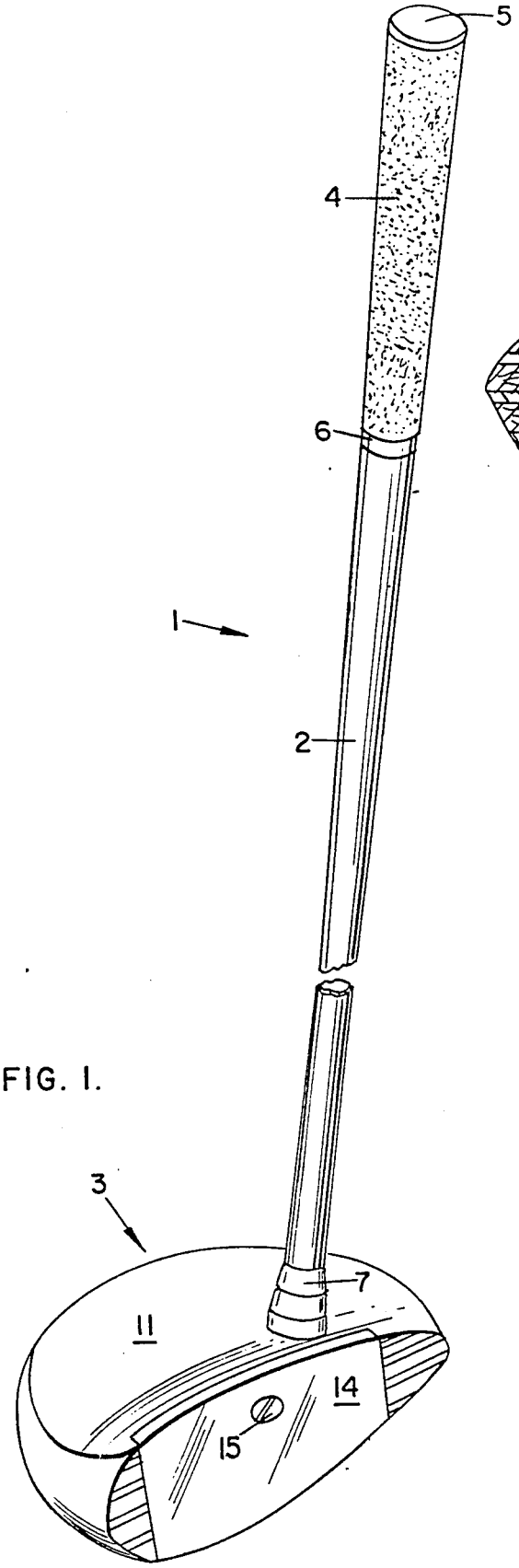
FIG. 1 is a perspective view of a golf club according to the invention.
Figure 2:
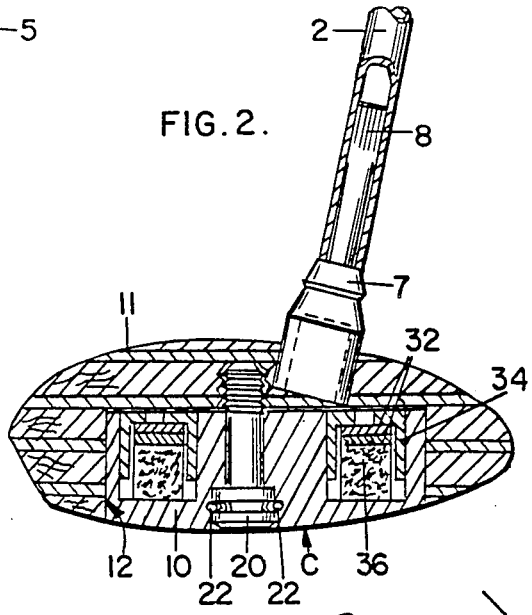
FIG. 2 is a sectional view of a portion of the FIG. 1 golf club.
Figure 3:
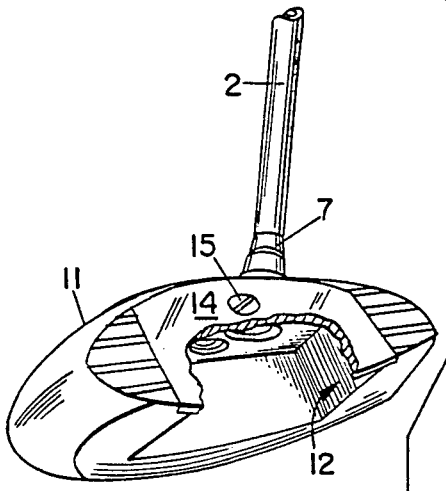
FIG. 3 is an exploded view of a portion of the club of FIG. 1.
Figure 3:
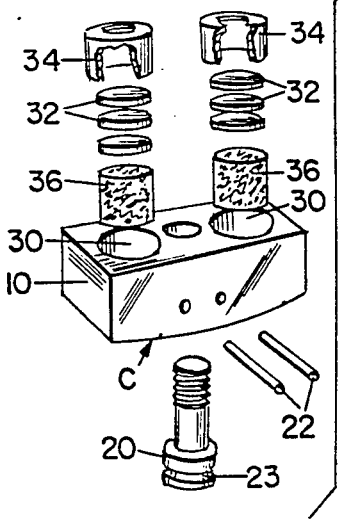

Referring initially to FIG. 1, I provide a golf putter indicated generally by reference numeral 1 and comprising a shaft 2, which may be of a hard wood such as hickory or of steel or aluminum and a head generally indicated by numeral 3.

At the outset it is to be explained that the club design lends itself to the use of different materials as well as different sizes and shapes.

A handle grip 4, usually of leather, can be secured to shaft 2 with the aid of a brass cap 5 and a ferrule 6.

Brass cap 5 may be recessed for purposes of retaining a weight or a plurality thererof, the weight being subsequently referred to, for purposes of storing excess weights used in the club head and/or balancing the shaft portion of the club to suit the whims of an individual player.

A brass end piece 7 is knurled at 8 to accomodate the end of shaft 2 sleeved thereon and at its opposite end is received in a provided opening in and welded to head 3 so as to be fixedly related thereto.

Head 3 comprises a base 10 of brass, partly surrounded by a cover 11 of ash or similar wood.

A recess is provided in cover 11 to receive base 10.

A ball striking plate 14 of brass is secured to cover 11 by a screw 15 and defines with the recess in the cover a well to receive base 10.

A screw 20 through base 10 engages a threaded hole in cover 11 to secure the base and the cover to each other.

Screw 20 is retained in the base by a pair of pins 22 which engage an annular groove 23 adjacent the head of the screw.

A pair of spaced weight receiving vertically-extending bores 30 extend partly into base 10 for receiving a one or more weights or discs 32 of equal increments.

A toe bore 30 is disposed forwardly of screw 20 and a heel bore 30 is disposed rearwardly of screw 20.

A pair of cylindrical cups or barrels 34 retain weights 32 together and a compressible means 36 in the form of a cylindrical plug of plastic foam biases weights 32 into cups 34 and in turn against cover 11 to retain the weights securely in head 3 and thereby preclude shifting about as the club is used.

The lower edge of the face of plate 14 is slightly curved to complement the overall curvature of the cover.

Too, the bottom of the base is radiused as indicated by C toward the rear, similarly to correspond with the cover contouring.

The weight of the head and the balance of the club may be selectively varied in small increments by adding or subtracting the number of weights in each recess.

Each weight will constitute a swing weight increment.

The cups may be of any weight but preferably should be a multiple of the incremental weights.

When it is desired to altar the weight of the club by an amount greater than the sum of the provided incremental weights, more dense weights could be used. Alternatively, a heavier base member could be provided, for example, a base which has a lead weight already preformed therein.

While the club has been provided with a head rigidly mounted to the shaft, the head, if desired, could be releasably mounted. Furthermore, it will be appreciated that any other suitable means for securing the base of the cover could be provided. For example, it may be desirable to have the screw completely removable from the base. Alternatively, the screw could be screwed through the cover to engage a threaded hole in the base.

The weight of the head can readily easily be altered by small increments by merely adding to or subtracting from the weights in the head. This is particularly advantageous to a golfer where he may be playing under different green or weather conditions. Additionally, it allows the same club to be used by many different golfers. By merely varying the weight, the club can be readily adapted to suit any particular individual. Additionally, because the weights stored in the shaft can be likewise varied, the putter may be readily adapted to different golfers or different weather, or putting conditions.

By producing a club embodying a swingweight increment principle, a principle whereby each weight equals one swingweight, integral multiple swingweights or reasonable fractions thereof (i.e. ½ swingweights), it allows a manufacturer to establish a very scientific, yet simply performed utility to the club.

The manufacturer may, by means of his processes, swingweight each of his clubs to a standard reference swingweight (before any weights have been installed). By doing so the club owner may then swingweight his club to any desired swingweight the club will accomodate without the use of gravimetric swingweight scales by simple additions (i.e. by adding the total number of swingweight increments he has installed in the club head to the original reference swingweight.

Swingweight scales, and the knowledge of their use, is normally found only in golf manufacturing facilities, golf club repair shops, and in some professional golf shops.

By standard referencing the clubs at the point of manufacture, and then standard referencing the weight system, it allows the player to swingweight his own club easily and accurately in a reasonably short period of time. He may perform this function as often as he wishes, being encouraged in competition to stay within the rules of golf.

I claim:

1. In a golf club consisting of a shaft and a head interconnected by a hosel, the improvement in means for modifying the club to a preferred weight level comprising:

the head consisting of a cover and a contact plate and a base, the contact plate having a front striking face and being vertically-extending and securable to the cover for defining cooperantly therewith a closed upwardly-projecting recess from the sole of the cover, the base having a forward toe and a rearward heel relative to the longitudinal axis of the head and being nestably receivable within the recess, an extension of the longitudinal axis of the shaft passing through the base between the toe and heel, the base having spaced vertically-extending downwardly-projecting closed recesses in the respective toe and heel, a screw in locked interengagement with and vertically extendable through and rotatable relative to the base between the recesses and threadedly engageable with the cover for releasably interengaging the cover and base, a barrel and a plurality of weight discs being selectively receivable in each of the recesses for weighting the respective toe and heel, each barrel being selectively receivable in its recess with the respective weight discs disposed upwardly thereof for the weighting of the upper region of the base or with the respective weight discs disposed downwardly thereof for the weighting of the lower region of the base, a compressible member being receivable in each respective barrel and disposable over the respective weight discs and barrel in maintaining the respective weight discs and barrel in tight relationship as to the base, the front striking face of the contact plate forwardly of the screw defining a preferred point of initial contact of the plate with a ball.

* * * * *